US009556003B2

(12) United States Patent
Abu Al-Rubb

(10) Patent No.: US 9,556,003 B2
(45) Date of Patent: Jan. 31, 2017

(54) LIFT SAFETY MECHANISM

(71) Applicant: Khalil Mahmoud Abu Al-Rubb, Doha (QA)

(72) Inventor: Khalil Mahmoud Abu Al-Rubb, Doha (QA)

( * ) Notice: Subject to any disclaimer, the term of this patent is extended or adjusted under 35 U.S.C. 154(b) by 97 days.

(21) Appl. No.: 14/573,767

(22) Filed: Dec. 17, 2014

(65) Prior Publication Data

US 2015/0101891 A1 Apr. 16, 2015

Related U.S. Application Data

(63) Continuation of application No. PCT/EP2013/062763, filed on Jun. 19, 2013.

(30) Foreign Application Priority Data

Jun. 21, 2012 (LU) ..... 92027

(51) Int. Cl.
*B66B 5/18* (2006.01)
*B66B 5/26* (2006.01)

(52) U.S. Cl.
CPC .. *B66B 5/18* (2013.01); *B66B 5/26* (2013.01)

(58) Field of Classification Search
CPC ..... B66B 5/18; B66B 5/26; B66B 5/16
USPC ... 187/359; 188/74, 78, 79, 82.1, 82.3, 82.5, 188/82.7, 82.8, 83, 85, 136
See application file for complete search history.

(56) References Cited

U.S. PATENT DOCUMENTS 4,538,706 A * 9/1985 Koppensteiner ..... B66B 5/22 187/376
5,002,158 A * 3/1991 Ericson ..... B66B 5/22 187/254
5,031,730 A * 7/1991 Marion ..... B60T 7/12 188/110
5,209,325 A * 5/1993 Gines ..... B60T 7/126 187/375
5,648,644 A * 7/1997 Nagel ..... B66B 5/18 187/288
6,131,703 A 10/2000 Gates
6,173,813 B1 * 1/2001 Rebillard ..... B66B 5/06 187/287
2003/0217895 A1 * 11/2003 Kigawa ..... B66B 5/282 187/344

(Continued)

FOREIGN PATENT DOCUMENTS

DE 19833772 A1 1/2000
EP 0366526 A1 5/1990

(Continued)

*Primary Examiner* — William A Rivera
*Assistant Examiner* — Michael Riegelman
(74) *Attorney, Agent, or Firm* — Seed IP Law Group LLP

(57) ABSTRACT

A safety mechanism for a lift system, the safety mechanism including a first motion retarder which operates frictionally between a load-carrying platform and a hoistway and a second motion retarder which operates by breaking a frangible element. The two motion retarders may act together so that when the frictionally engaging element is depleted, the frangible elements are then broken. In an embodiment, the frictional element is disengaged to engage the breaking of the frangible elements when the car is a predetermined distance above a floor of the hoistway, thereby ensuring that the load-carrying platform can be stopped prior to a collision with the floor or ceiling of the hoistway.

26 Claims, 5 Drawing Sheets

(56) References Cited

U.S. PATENT DOCUMENTS

| | | | | |
|---|---|---|---|---|
| 2008/0230324 | A1* | 9/2008 | Ferrisi | B66B 5/286<br>187/343 |
| 2012/0222918 | A1* | 9/2012 | Billard | B66B 5/22<br>187/359 |

FOREIGN PATENT DOCUMENTS

| | | | |
|---|---|---|---|
| EP | 1437320 | A1 | 7/2004 |
| EP | 2050706 | A1 | 4/2009 |
| WO | 2007/043991 | A1 | 4/2007 |

* cited by examiner

LIFT SAFETY MECHANISM

BACKGROUND

Technical Field

The present disclosure relates to a mechanism for improving the safety of lifts.

Description of the Related Art

Lifts transport people and goods from place to place, usually in a vertical direction. Safety has always been a major concern due to the catastrophic consequences of a failure in a lift. One of the major contributors to the commercialization of passenger lifts was the invention by Elisha Otis in 1852 of a practical safety mechanism for passenger lifts.

A number of different safety mechanisms are known. For example, DE19833772 discloses two locking bars arranged below a passenger car of a lift. The locking bars are kept in a retracted position by a load cable so that when the load cable snaps the locking bars extend to engage with rungs situated in the hoistway. The rungs may rupture to provide a breaking force.

U.S. Pat. No. 6,131,703 discloses a safety mechanism for a lift which includes brake pads which may be brought into engagement with braces. To provide additional braking power, the pads are provided with protrusions which engage with corrugations, flattening these corrugations as the protrusions pass thereover.

BRIEF SUMMARY

According to an embodiment, there is provided a safety mechanism for a lift, the lift comprising a load-carrying platform arranged for movement relative to a hoistway, the safety mechanism comprising first and second motion retarders acting between the load-carrying platform and the hoistway for reducing a speed of the load-carrying platform relative to the hoistway wherein the first motion retarder includes a friction brake and the second motion retarder includes a frangible element.

The first safety mechanism may include a pad which engages frictionally with the hoistway to retard a speed of the load-carrying platform, the frictional engagement of the pad with the hoistway causing depletion of the pad, and the second motion retarder may be mounted relative to the first motion retarder so that depletion of the pad causes engagement of the second motion retarder.

The safety mechanism may further comprise a hook wherein engagement of the second motion retarder occurs when the hook engages with the frangible element so that a tearing of the frangible element by the hook reduces a speed of the load-carrying platform. The hook may be attached to the load-carrying platform and the frangible element may be attached to the hoistway.

The second motion retarder may further comprise a biasing means for encouraging the hook into engagement with the frangible element.

The safety mechanism may further comprise retention means for preventing engagement between the hook and the frangible element, wherein the retention means is adapted to be operational during normal operation of the associated lift. The retention mechanism may be further adapted to disengage during an emergency situation. In an embodiment, the retention mechanism is an electromagnet.

The safety mechanism may further comprise swapping means for disengaging the first motion retarder and engaging the second motion retarder.

The first motion retarder may have an operational element pivotally moveable relative to the second motion retarder and wherein the swapping means causes pivoting of the operational element to thereby cause disengagement of the first motion retarder and engagement of the second motion retarder. The operational element may include a pad which is frictionally engaged with an element mounted on a hoistway.

The swapping element may be adapted to be mounted a predetermined distance from a base of the hoistway.

The frangible element may be mounted relative to the hoistway.

The second motion retarder may include a plurality of frangible elements mounted relative to the hoistway, and in this case each frangible element may comprise a recess adapted to receive a hook which, when the second motion retarder is engaged, causes tearing of the frangible element.

In an embodiment, a method of retarding the motion of a lift, wherein the lift comprises a load-carrying platform arranged for movement relative to a hoistway, includes reducing a speed of the lift by applying friction between the load-carrying platform and the hoistway and reducing the speed of the lift by breaking a frangible element.

The applying friction may include engaging a pad frictionally with the hoistway to retard a speed of the load-carrying platform, wherein the frictional engagement of the pad with the hoistway causes depletion of the pad, and the method further comprising engaging said breaking said frangible element in response to said depletion of said pad.

The breaking said frangible element may include bringing a hook into engagement with said frangible element.

The hook may be attached the load-carrying platform and the frangible element may be attached to the hoistway.

The method may further comprise biasing the hook into engagement with the frangible element.

The method may further comprise retaining the hook relative to the frangible element, with a retaining means, to prevent engagement between the hook and the frangible element, during normal operation of the associated lift.

The method may further comprise disengaging the retaining means during an emergency situation.

The retention mechanism may be an electromagnet.

The method may further include disengaging the friction and engaging means to break the frangible element.

The method may include pivotally moving a friction engaging element relative to said means to break the frangible element.

The friction engaging element may include a pad which is frictionally engaged with an element mounted on a hoistway.

The pivotally moving the friction engaging element may occur when the load-carrying platform is located a determined distance from a bottom of the hoistway.

BRIEF DESCRIPTION OF THE SEVERAL VIEWS OF THE DRAWINGS

Example embodiments are described with reference to the accompanying schematic diagrams where.

DETAILED DESCRIPTION

Example embodiments are described hereafter with reference to the accompanying diagrams.

Figure 1:
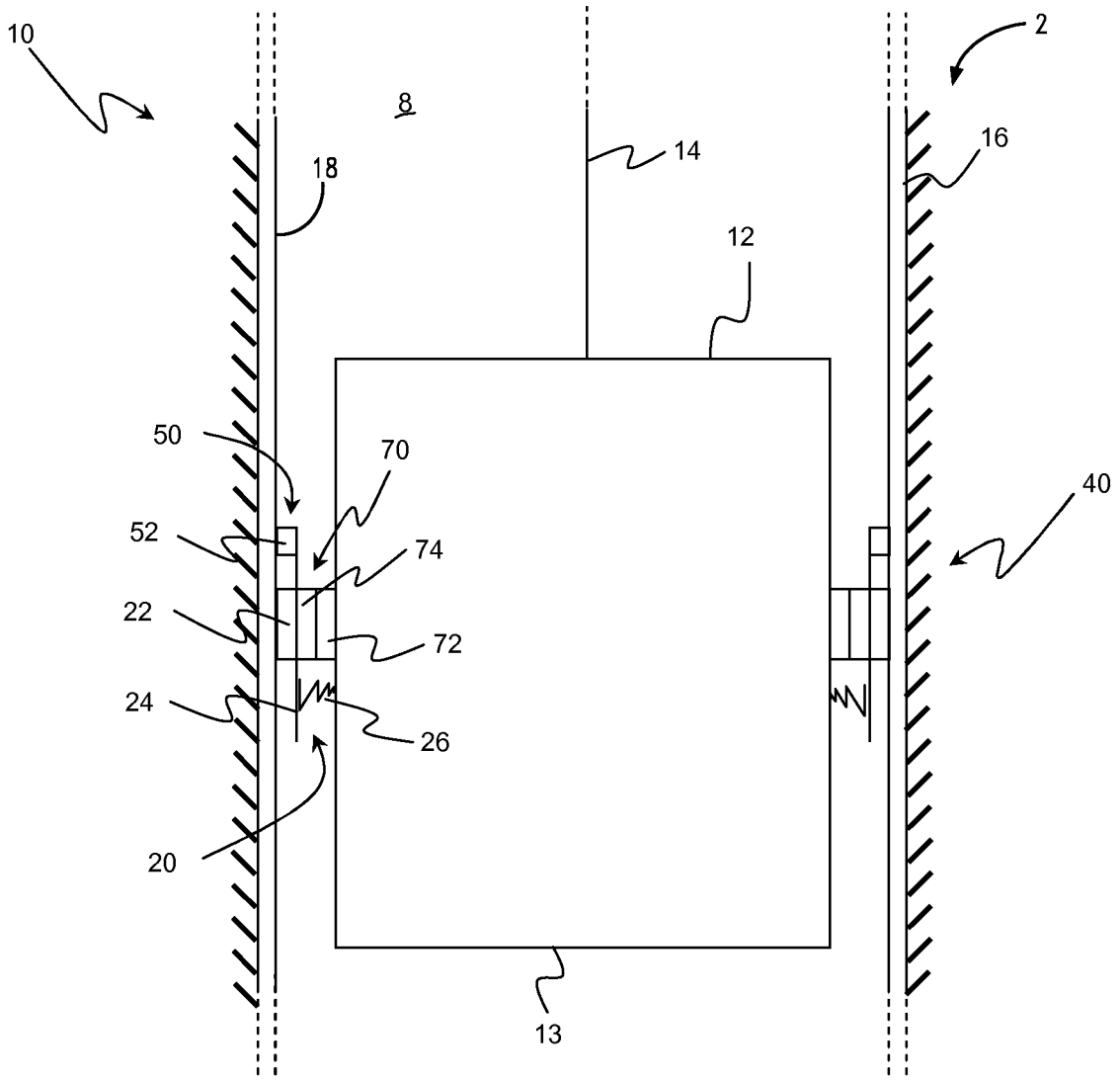
FIG. 1 is a schematic diagram of a lift safety mechanism according to an embodiment.

FIG. 1 illustrates a lift system 2 comprising a passenger car 12 supported by a hoist cable 14. In this embodiment, the passenger car 12 includes a load-carrying platform 13 on which the passengers stand during transport in the car 12. The passenger car 12 moves vertically within a hoistway 8 under the action of a motor and counterweight, neither of which are illustrated in the accompanying drawings, in a known manner. The hoistway 8 is a vertical void formed in a structure such as a building defined by walls 18. Tracks 16 run on either side of the hoistway 8 and define a path along which the car 12 travels.

It is to be realised that embodiments are not limited to lifts which operate vertically or to those which operate in buildings.

The lift system 2 includes a safety mechanism 10 which includes a first motion retarder 20 and a second motion retarder 50. Embodiments therefore include two, or more, safety devices which may act in concert. In general, multiple safety devices have not hitherto been utilized due to the cost and complexity which this adds to lift construction. Using two or more such safety devices has the advantage that one safety mechanism may act as a backup to the other. This increases the likelihood that, even in the situation where one of the safety devices fails, the other will be able to act as a backup.

The safety mechanism 10 including both the first motion retarder 20 and the second motion retarder 50 is provided on one side of the passenger car 12. In the embodiment illustrated, a further safety mechanism 40, comprising two similar motion retarders, is also provided on the other side of the passenger car. In the description which follows, the operation of the motion retarders 20 and 50 will be described. However, it is to be realised that the same considerations and descriptions apply in respect of the other safety mechanism 40.

The first motion retarder 20 and the second motion retarder 50 are brought into engagement when an emergency situation is detected, as discussed in further detail below. The lift system 6 includes an electromagnet 70 which disengages when such an emergency situation is detected. The electromagnet 70 includes a base 72 attached to the passenger car 12 and a mount 74 engaged with the base 72. The power cable for the electromagnet 70 is embedded in the hoist cable 14.

The first motion retarder 20 and the second motion retarder 50 are connected to the mount 74. When the electromagnet 70 is engaged, motion of the mount 74 relative to the base 72 is prevented. However, when the electromagnet 70 is turned off or disengaged, movement of the mount 74 relative to the base 72 is permitted.

In an embodiment, the electromagnet 70 continues to be engaged until it is purposively disengaged (e.g. when an emergency situation is detected) or when the electrical power supply to the magnet is interrupted. Therefore, if electrical power supplied to the lift system 6 is interrupted, the electromagnet 70 will disengage and thereby engage the first and second motion retarders. This facilitates embodiments operating as safety mechanisms even in the absence of power being supplied to the lift system 6.

Turning again to FIG. 1, the first motion retarder 20 comprises a lever 24 connected, near its base, to a spring 26. The electromagnet 70 fastens the position of the lever 24 and prevents it from moving. When the electromagnet is released, the lever is allowed to move under the influence of the spring 26 which pulls the base of the lever 24 towards the passenger car 12.

The first motion retarder also includes a brake pad 22 attached to the lever 24 at the location of the mount 74 of electromagnet 70. When the lever 24 moves under the influence of the spring 26, the top of the brake pad 22 is brought into engagement with the track 16 (discussed below with reference to FIG. 3) formed on a wall 18 of the hoistway 8. Friction between the brake pad 22 and the track 80 will counter the downward motion of the passenger car 12 when the hoist cable 14 no longer supports the car. Therefore, the brake pad 22 can be brought into engagement with the track 16 when an emergency is detected. For example, when the hoist cable has been severed.

However, as the brake pad 22 engages with the track 16, friction between the pad and the track will cause wear on the pad. As the pad 22 wears, the force with which the spring 26 acts on the lever 24 will diminish. Therefore the force with which the pad 22 is brought into contact with the track 16 will likewise diminish.

The second motion retarder 50 comprises a hook 52 attached to the end of the lever 24 opposite to the base where the spring 26 is attached. As the brake pad is worn, the hook will move closer to the wall 18 of the hoistway 8.

Figure 2:
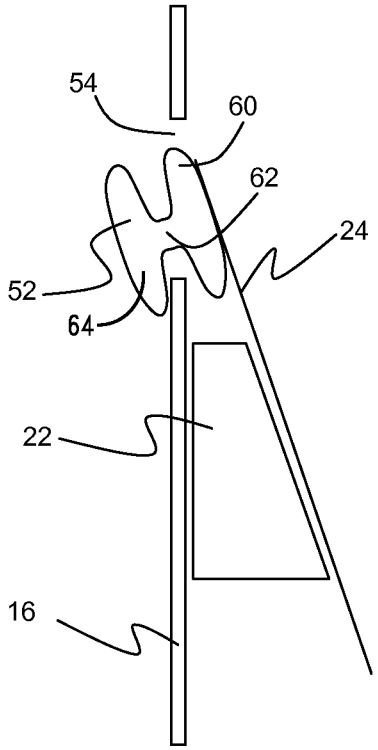
FIG. 2 is a schematic diagram of a detail of the lift safety mechanism of FIG. 1 according to an embodiment.

FIG. 2 illustrates the configuration where the pad 22 has worn away sufficiently that the hook 52 (illustrated here in greater detail) is brought into engagement with an aperture 54 formed in the track 16 provided on the wall 18 of the hoistway 8. The hook 52 comprises a base 60 connected by a substantially thinner neck 62 to a thicker head 64.

Figure 3:
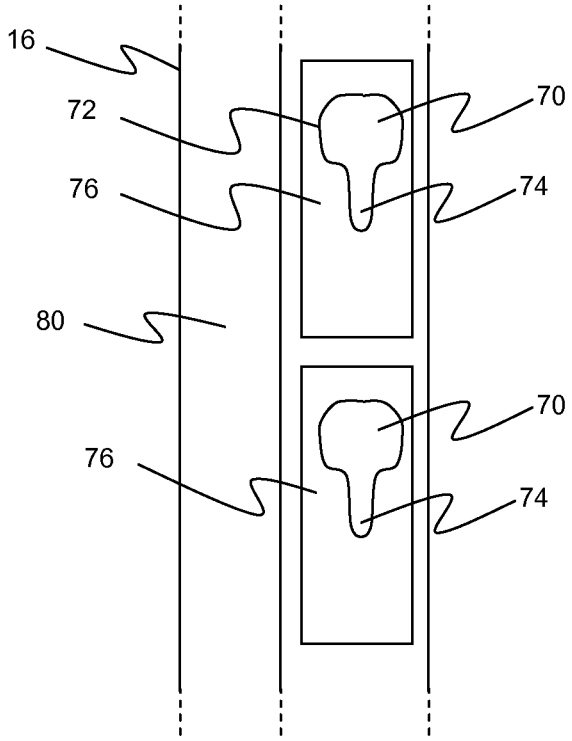
FIG. 3 is a schematic diagram of a detail of the lift safety mechanism of FIG. 1 according to an embodiment.

FIG. 3 illustrates the track 16 provided on the side wall 18 of the hoistway 8. Track 16 includes a braking track 80 against which the brake pad 22 engages. The track 16 further includes a plurality of keyhole apertures 70 provided adjacent to the brake track 80. Each keyhole aperture 70 comprises a larger upper void 72 and a smaller, elongate lower void 76 to provide a keyhole shape. Each aperture 70 is formed in a frame 76 comprised of a frangible material. Therefore each aperture 70 together with each frangible material 76 forms a frangible element.

The apertures 70 are keyhole-shaped. When the brake pad 22 (FIG. 2) has worn down sufficiently the hook 52 is in a position that it may engage with one of the apertures 70. The head 64 of the hook 54 is shaped to be located in the upper, larger void 72 of an aperture 70. When this occurs, the shape of the head, which tapers down to the neck 62 of the hook 52, encourages the neck 62 to be located in the lower, elongate portion 74 of the aperture 70.

As the passenger car 12 continues its downward movement (with reference to the direction of FIG. 1), the neck 62 will cause the frangible material of frame 76 to tear. The energy needed to tear this material will provide a stopping force to the passenger car 12.

Therefore, the second motion retarder 50 will provide a further stopping force to the passenger car 12 when the first motion retarder 20 becomes ineffectual due to wear on the brake pad 22. Therefore, in embodiments, two motion retarders are provided; configured and arranged so that when the first retarder is ineffectual, the second retarder is engaged. Therefore, the second motion retarder acts as a backup to the first motion retarder.

It is to be realised however, that the first motion retarder will serve to stop the passenger car in almost all emergency situations. It is only in those cases where the initial speed, height and weight of the passenger car when the emergency occurs combine to render the first motion retarder insufficient to stop the car completely.

Figure 4A:
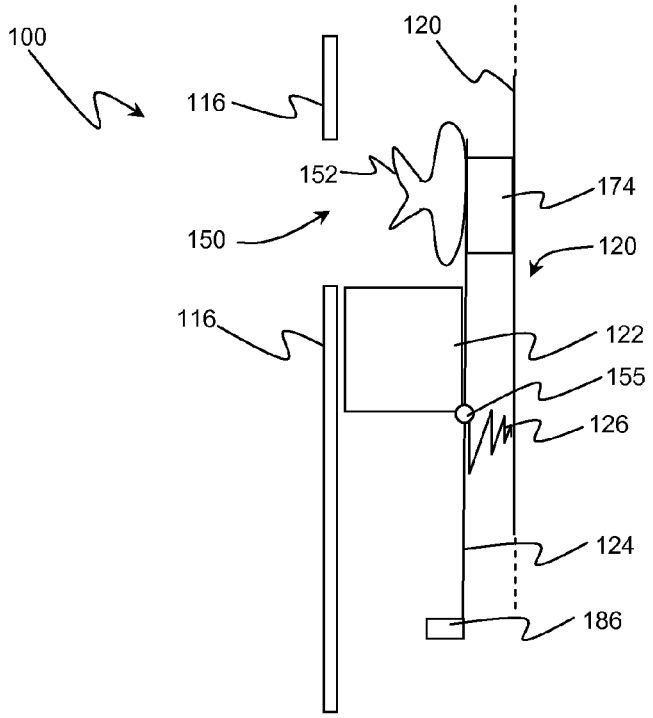
FIG. 4A is a schematic diagram of a lift safety mechanism according to an embodiment in a first example configuration.
Figure 4B:
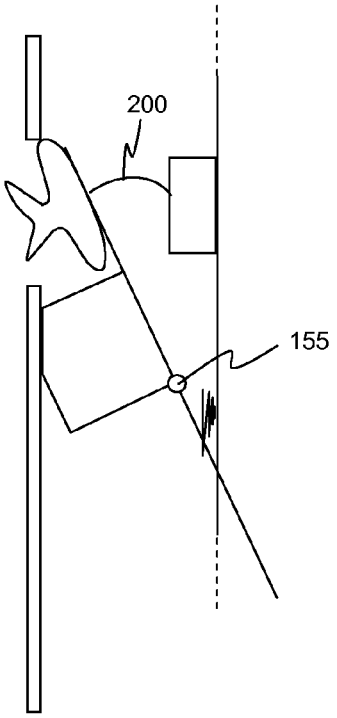
FIG. 4B is a schematic diagram of the lift safety mechanism of FIG. 4A in a second example configuration.

FIGS. 4A and 4B illustrate a lift safety mechanism 100 according to an embodiment. The lift safety mechanism 100 includes a first motion retarder 120 and a second motion retarder 150. A lever 124 is connected to a passenger car 120 and arranged to pivot in two planes about a pivot point 155 (as described below in greater detail). The first motion retarder 120 is similar to the first motion retarder 20 of the embodiment illustrated in FIGS. 1 to 3, and includes a brake pad 122 arranged on the lever 124 so that when the first motion retarder 120 is engaged, the brake pad 122 engages with the track 116 provided on the hoistway wall.

As the brake pad 122 engages with the track 116 the brake pad will wear. FIG. 4B illustrates the configuration of the safety mechanism 100 after a period of wear on the brake pad 122 has occurred.

The safety mechanism 100 of this embodiment includes a pivot guide 200 which serves to locate the hook 152 in an aperture 170 (see FIG. 5) in the track 116.

Figure 5:
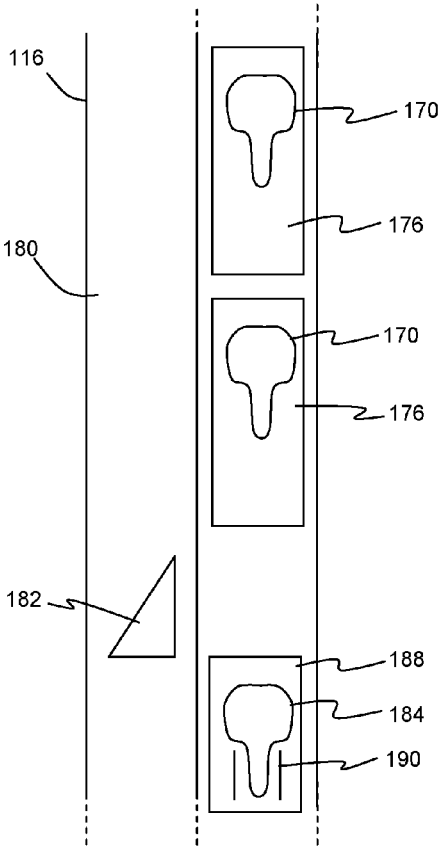
FIG. 5 is a schematic diagram of an embodiment of a portion of a lift safety mechanism of FIGS. 4A and 4B.

FIG. 5 illustrates the track 116 of an embodiment of the safety mechanism. With reference to FIGS. 4 and 5, the track 116 includes a brake track 180 with which the brake pad 122 engages to provide a first means for retarding the downwards motion of the passenger car, in a manner similar to that described above with reference to FIGS. 1 to 3. In addition, the track 116 includes a plurality of keyhole apertures 170 provided in a frangible frame having frangible material 176. The keyhole apertures therefore provide a second means of retarding the downward motion of the passenger car and operate in the same manner as the keyhole apertures 70 of FIG. 3, the operation of which is described above.

In an embodiment, the keyhole apertures 170 are located so that when the passenger lift does come to an emergency stop, the lift will be located so that passengers are able to alight onto a floor of the building in which the lift is operational, and are not stuck between floors.

In the embodiments illustrated in FIGS. 4 and 5, the brake tracks are located to one side of the line of apertures with which the hooks may engage. In some embodiments, the brake tracks are located in line with the apertures and/or on both sides thereof.

Figure 6:
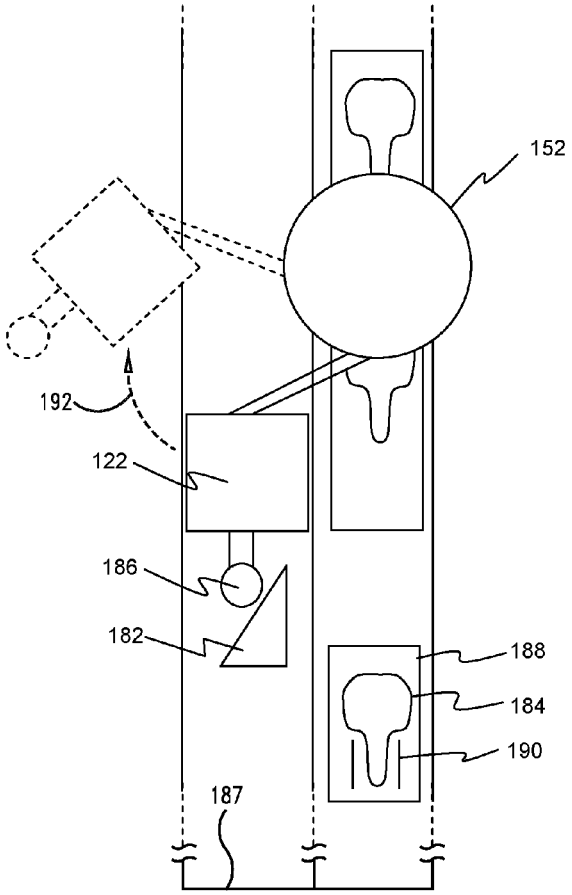
FIG. 6 is a schematic diagram of an embodiment of a portion of a lift safety mechanism of FIGS. 4A and 4B.

The embodiments of FIGS. 4 to 6 differ from those of FIGS. 1 to 3 in that the arrangement illustrated in FIG. 5 includes a wedge or prism-like protrusion 182 formed at a determined height, in-line with the keyhole apertures 170 of this embodiment. The lever 124 includes a co-operating nub 186. The wedge protrusion 182 is shaped so that, when the nub 186 engages with the wedge protrusion, the entire assembly comprising the first and second motion retarders will be laterally displaced to the orientation shown in FIG. 6 in dotted outline. This lateral displacement is shown by dashed arrow 192. In this orientation, the hook 152 engages with a laterally displaced tearing strip 188. The tearing strip 188 comprises second frangible material 184 with reinforcing 190. The wedge protrusion 182 therefore acts as a swapping means to swap between the frangible material 170 and the second frangible material 184.

The reinforcing 190 in the frangible material 184 provides the tearing strip 188 with greater stopping power than the apertures 170. The swapping means, in the form of the wedge protrusion and the co-operating nub 186, together with the tearing strip 188, mean that an embodiment is able to provide increased stopping power at a determined height. In an embodiment, when the passenger car is nearing the bottom 187 of the hoistway, and it is unlikely that the frangible material 170 will provide sufficient retarding action to bring the passenger car to a stop, the more resilient frangible material 184 can be engaged. The reinforcing on tearing strip 188 will then facilitate ensuring that the car will be brought to a stop. Although this may increase the risk of injury by providing a more abrupt stop that is ideally desirably, it reduces the risks of very serious or critical injury by preventing a collision between the bottom, or top, of the hoistway and the passenger car.

Figure 7:
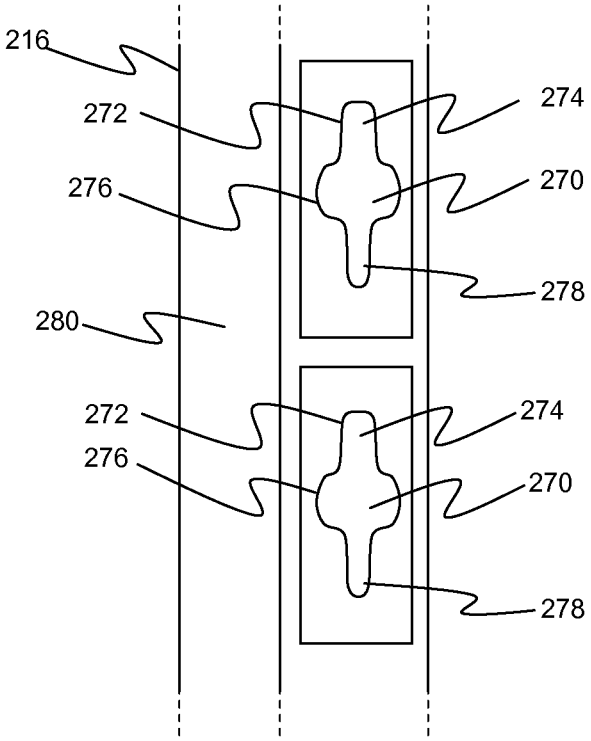
FIG. 7 is a schematic diagram of a track according to an embodiment.

FIG. 7 is a schematic diagram of a track 216 according to an embodiment. This track 216, in a manner similar to the tracks 16 and 116 described above, is designed to be attached to the side wall of a hoistway. The track 216 may be used with any of the safety mechanisms illustrated in FIGS. 1 to 6.

The track 216 includes a number of apertures 272, only two of which are illustrated in this Figure. Each aperture 272 includes a central enlarged portion 270 above and below which are located respective elongated portions 274 and 278. The central enlarged portion 270 is adapted to engage with a corresponding hook in the manner described above. The track 216 has the advantage that it is able to slow and stop lift cars travelling upwards as well as those travelling downwards.

Similarly, the arrangement illustrated in FIGS. 5 and 6 whereby the swapping means causes the lateral displacement of the retarding means may be mirrored at the top of the hoistway to be engaged in those situations where the upwards movement of the lift car need be retarded to avoid injury to the occupants.

It is to be realised that embodiments are applicable to all sorts of vertically arranged lifting mechanisms. Certain embodiments relate to passenger lifts such as those discussed above, whereas further embodiments relate to hoists comprising a load-bearing platform having no retaining walls and no upper covering such as a ceiling. Yet further embodiments relate to hoists comprising a load-bearing platform with one or more retaining walls and ceiling.

Either or both of the first and second retarding means described above, or according to further embodiments, may be engaged in dependence on an output of a sensor, preferably as interpreted by appropriate logic. In an embodiment, the passenger car is fitted with a sensor which determines the speed of the passenger car relative to the hoistway. (Various sensors can be applied to achieve the same end result: a signal to engage the safety mechanisms). When this speed exceeds a determined amount, an emergency situation is declared and the electromagnet (74 or 174) disengaged to cause the brake pad (22 or 122) to engage, to thereby slow the passenger car down, and eventually stop. As previously described, this action also, in an embodiment, causes engaging of the hook and aperture retarding means, if the brake pad wears away past a determined point.

Appropriate speed sensors are, in an embodiment, based on laser distance measures such as the DLS-C or FLS-C sold by Dimetix AS of Herisau, Switzerland.

Arrangements according to embodiments may be relatively simple when compared to many known safety mechanisms as they do not rely on complex electronics and associated software. Therefore, they may be cheaper to implement and maintain and may be particularly suited to cheaper lift installations such as hoists.

The invention claimed is:

1. A safety mechanism for a lift, the lift comprising a load carrying platform arranged for movement relative to a hoistway, the safety mechanism comprising first and second motion retarders acting between the load-carrying platform and the hoistway for reducing a speed of the load-carrying platform relative to the hoistway wherein the first motion retarder includes a friction brake and the second motion retarder includes a tearable element, wherein the first motion retarder includes a brake pad which engages frictionally with the hoistway to retard the speed of the load-carrying platform, the frictional engagement of the brake pad with the hoistway causes wear of the brake pad, and the second motion retarder is mounted relative to the first motion retarder so that the second motion retarder engages in response to wear of the brake pad below a threshold brake pad level.

2. The safety mechanism according to claim 1, comprising a hook wherein engagement of the second motion retarder occurs when the hook engages with the tearable element so that a tearing of the tearable element by the hook reduces the speed of the load-carrying platform.

3. The safety mechanism according to claim 2 wherein the hook is attached to the load-carrying platform and the tearable element is attached to the hoistway.

4. The safety mechanism according to claim 3 wherein the tearable element is a first frangible element, the second motion retarder comprises a second frangible element and the safety mechanism comprises swapping means for disengaging the hook from the first frangible element and for engaging the hook with the second frangible element.

5. The safety mechanism according to claim 4 wherein the swapping means causes lateral displacement of the hook.

6. The safety mechanism according to claim 5 wherein the swapping means is adapted to be mounted a determined distance from a bottom of the hoistway.

7. The safety mechanism according to claim 6 wherein the swapping means comprises a wedge mounted to the hoistway at the determined distance from the bottom of the hoistway.

8. The safety mechanism according to claim 2 wherein the second motion retarder comprises a biasing means for encouraging the hook into engagement with the tearable element.

9. The safety mechanism according to claim 8, comprising retention means for preventing engagement between the hook and the tearable element, wherein the retention means is adapted to be operational during normal operation of the associated lift.

10. The safety mechanism according to claim 9 wherein the retention means is further adapted to be disengaged during an emergency situation.

11. The safety mechanism according to claim 9 wherein the retention means is an electromagnet.

12. The safety mechanism according to claim 1, comprising swapping means for disengaging the second motion retarder and engaging a third motion retarder.

13. The safety mechanism according to claim 1 wherein the tearable element is a first frangible element and the second motion retarder comprises a second frangible element.

14. The safety mechanism according to claim 1 wherein the tearable element is mounted relative to the hoistway.

15. The safety mechanism according to claim 14 wherein the second motion retarder includes a plurality of frangible elements mounted relative to the hoistway, each frangible element comprising a recess adapted to receive a hook which, when the second motion retarder is engaged, causes tearing of the frangible element.

16. A method of retarding motion of a lift, the lift comprising a load-carrying platform arranged for movement relative to a hoistway wherein the method includes reducing a speed of the load-carrying platform by applying friction between the load-carrying platform and the hoistway and reducing the speed of the load-carrying platform by breaking a tearable element, wherein the applying friction includes engaging a brake pad frictionally with the hoistway to retard the speed of the load-carrying platform, wherein the frictional engagement of the brake pad with the hoistway causes wear of the break pad, and the method comprises breaking said tearable element in response to said wear of said brake pad below a threshold brake pad level.

17. The method according to claim 16 wherein said the breaking said tearable element includes bringing a hook into engagement with said tearable element.

18. The method according to claim 17 wherein the hook is attached to the load-carrying platform and the tearable element is attached to the hoistway.

19. The method according to claims 17 comprising biasing the hook into engagement with the tearable element.

20. The method according to claim 19 comprising retaining the hook relative to the tearable element, with a retaining means, to prevent engagement between the hook and the tearable element, during normal operation of the associated lift.

21. The method according to claim 20 comprising disengaging the retaining means during an emergency situation.

22. The method according claim 20 wherein the retaining means is an electromagnet.

23. The method according to claim 19, wherein the tearable element is a first frangible element, comprising swapping the hook from the first frangible element to a second frangible element; and breaking the second frangible element to retard motion of the load-bearing platform.

24. The method according to claim 23 wherein the swapping includes inducing a lateral displacement of the hook.

25. The method according to claim 24 wherein the swapping is initiated at a determined distance from a bottom of the hoistway.

26. The method according to claim 16, wherein the tearable element is a first frangible element, comprising breaking a second frangible element to retard motion of the load-bearing platform.

* * * * *